US006350142B1

(12) United States Patent
Shirai et al.

(10) Patent No.: US 6,350,142 B1
(45) Date of Patent: Feb. 26, 2002

(54) ZIF TYPE SOCKET

(75) Inventors: Hiroshi Shirai, Saitama; Yoshihisa Yamamoto; Tomoo Yamada, both of Kanagawa; Shintaro Abe, Chiba, all of (JP)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/594,423

(22) Filed: Jun. 15, 2000

(30) Foreign Application Priority Data

Jun. 15, 1999 (JP) ..... 11-167832

(51) Int. Cl.[7] ..... H01R 4/50; H01R 13/625

(52) U.S. Cl. ..... 439/342; 439/268

(58) Field of Search ..... 439/342, 259, 439/264, 268; 70/57, 57.1, 158, 166–169

(56) References Cited

U.S. PATENT DOCUMENTS

| | | | | |
|---|---|---|---|---|
| 4,531,792 A | * | 7/1985 | Oshitani et al. | 439/342 |
| 5,622,514 A | | 4/1997 | Crompton, III et al. | 439/342 |
| 5,707,247 A | | 1/1998 | Konstad | 439/342 |
| 5,808,870 A | | 9/1998 | Chiu | 361/705 |
| 5,833,483 A | | 11/1998 | Lai et al. | 439/342 |
| 5,850,691 A | | 12/1998 | Bell | 29/845 |
| 6,071,140 A | | 6/2000 | McHugh et al. | 439/342 |
| 6,086,402 A | | 7/2000 | Huang | 439/342 |
| 6,109,947 A | * | 8/2000 | Lin | 439/342 |

FOREIGN PATENT DOCUMENTS

| | | | |
|---|---|---|---|
| JP | 02054632 | * | 8/1983 |
| JP | 59-180435 | | 1/1984 |
| JP | 59180435 | * | 12/1984 |
| JP | 2-54632 | | 11/1990 |

* cited by examiner

*Primary Examiner*—Paula Bradley
*Assistant Examiner*—Felix O. Figueroa

(57) ABSTRACT

A compact ZIF type socket is provided having the durability to withstand numerous movements of the slider. The ZIF type IC socket 1 consists of a base housing assembly 10 that accommodates numerous contacts, and a cover housing assembly 40 that can slide over the base housing assembly 10. The cover housing assembly 40 is caused to move in relative terms by inserting a plate-form tool 99 into tool insertion holes 65 and 85 respectively formed in a metal supporting plate 60 on the side of the base housing assembly 10 and a metal supporting plate 80 on the side of the cover housing assembly 40, and rotating this tool 99. The action points of the tool insertion holes 65 and 85 contacted by the tool 99 are formed as circular-arc-form projections 75, 76, 95 and 96. Accordingly, the force of the tool 99 can be transmitted to the base housing assembly 10 and cover housing assembly 40 without causing indentation or damage, etc., of the tool insertion holes 65 and 85, so that a highly durable ZIF type socket can be obtained.

13 Claims, 9 Drawing Sheets

ZIF TYPE SOCKET

FIELD OF THE INVENTION

The present invention relates to a ZIF type socket, especially a ZIF type IC socket which is used for the mutual connection of an IC package such as a BGA (ball grid array) and a board.

BACKGROUND OF THE INVENTION

As performance of central processing units (CPUs) has dramatically increased, there has become a widespread need in computers for easy replacement of existing CPUs with higher-speed CPUs. In such cases, zero insertion force (ZIF) type sockets are widely used as sockets for accommodating the CPU package and making mutual connections with the circuit board. Generally, ZIF type sockets have a lever which drives a slider that opens and closes an internal contact, as shown in Japanese Utility Model Application Kokai No. 59-180435.

In recent years, however, there has been a dramatic reduction in the size of personal computers, as typified by notebook type personal computers, so that the extra space or volume required for the pivoting of a lever has already disappeared. Accordingly, an IC socket which is not equipped with a lever, and in which the slider is driven using a tool such as a screwdriver, etc., only when the IC package (such as a CPU, etc.) is replaced, has been proposed. For example, in Japanese Patent Application Kokoku No. 2-54632, a ZIF type IC socket (shown here in FIGS. 13 and 14) is disclosed in which the contact spring parts 142 of contacts 140 are caused to contact the leads (not shown in the figures) of the IC package by means of a tool 170 with a rectangular cross-sectional shape that is separate from the IC socket 110, as shown in FIG. 13. In order to cause the contact spring parts 142 of the contacts 140 to contact the leads of the IC package, the tip end of the tool 170 is first inserted into a substantially triangular tool insertion hole 152 formed in the slider 150 and an oppositely oriented substantially triangular tool insertion hole 134 (see FIG. 14) formed in the socket main body 130. Next, the slider 150 is caused to move in the direction indicated by arrow A (see FIG. 14) by turning the tool 170 in the clockwise direction. As a result of the movement of the slider 150, the spring contact p arts 142 of the contacts 140 accommodated inside the recesses 154 of the slider 150 are driven outward so that these spring contact parts 142 contact the leads of the IC package.

However, the socket main body 130 and slider 150 are generally made of plastic; accordingly, when the slider 150 is moved by turning the tool 170, one side edge portion 172 of the tool 170 bites into one side 152*a* of the substantially triangular tool insertion hole 152, so that there is a danger of indentation or damage, etc., occurring in this side 152*a*. As a result, the IC socket 110 cannot withstand numerous insertions and removals of IC packages, i. e., numerous movements of the slider 150.

Furthermore, the action point of the tool insertion hole 152 of the slider 150 that contacts the tool 170 is always in a position that contacts a corner (side edge portion 172) of the tool 170. As a result, the distance from the rotational fulcrum of the tool 170 is relatively large, so that the force required in order to rotate the tool 170 cannot be reduced.

SUMMARY OF THE INVENTION

Accordingly, one object of the present invention is to provide a compact ZIF type sock et which has the durability to withstand numerous movements of the slider.

Furthermore, another object of the present invention is to provide a ZIF type socket in which the force required in order to drive the tool is relatively small.

The ZIF type socket of the present invention is characterized by the fact that in a ZIF type socket which consists of a base housing that accommodates numerous contacts, and a slider that can move across said base housing, and in which the aforementioned slider is caused to move by inserting a plate-form tool into tool insertion holes formed in the aforementioned base housing and the aforementioned slider and rotating said tool, the action points of the aforementioned tool insertion holes contacted by the aforementioned tool are circular-arc-form projections.

It may be desirable that the members that have the circular-arc-form projections be metal members that are separate from the aforementioned base housing and slider, and that are respectively attached to the aforementioned base housing and slider.

Furthermore, the distance between the circular-arc-form projections on the side of the base housing and the circular-arc-form projections on the side of the slider may be shorter than the length of the long side of the tool.

BRIEF DESCRIPTION OF THE DRAWINGS

Embodiments of the ZIF type IC socket of the present invention will now be described by way of example with reference to the following drawings, wherein:

FIGS. 1A–C illustrates a working configuration of the IC socket of the present invention, wherein FIG. 1(A) is a plan view, FIG. 1(B) is a front view, and FIG. 1(C) is a right-side view;

FIGS. 4A–4C illustrate the base housing assembly of the IC socket shown in FIG. 1 wherein FIG. 4(A) is a plan view, FIG. 4(B) is a front view, and FIG. 4(C) is a right-side view;

FIGS. 7A–7C illustrate the cover housing of the IC socket shown in FIG. 1, wherein FIG. 7(A) is a plan view, FIG. 7(B) is a front view, and FIG. 7(C) is a right-side view;

FIGS. 9A–9C illustrate the base supporting plate of the present invention, wherein FIG. 9(A) is a plan view, FIG. 9(B) is a partial sectional view taken along line 9B—9B in FIG. 9(A), and Figure (C) is a back view.

DETAILED DESCRIPTION OF THE INVENTION

Figure 1A:
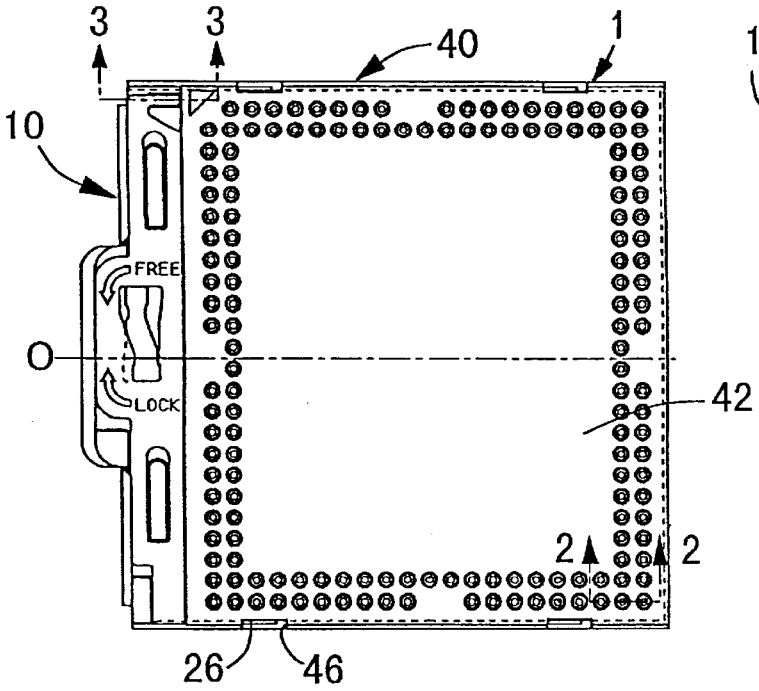
Figure 1C:
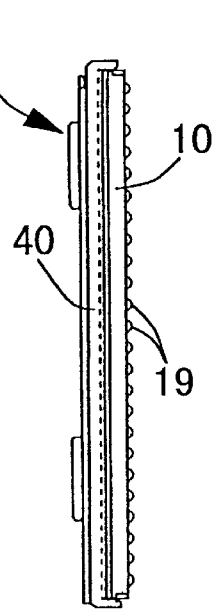
Figure 1B:
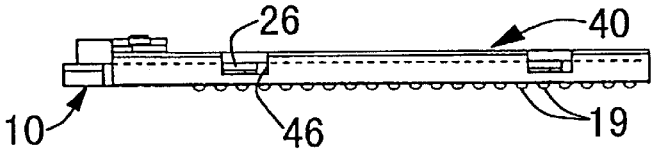
Figure 2:
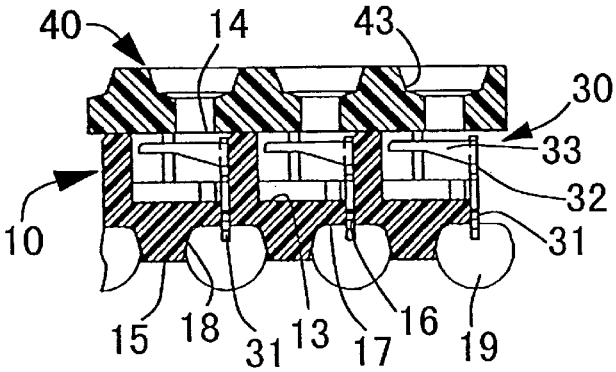
Figure 4A:
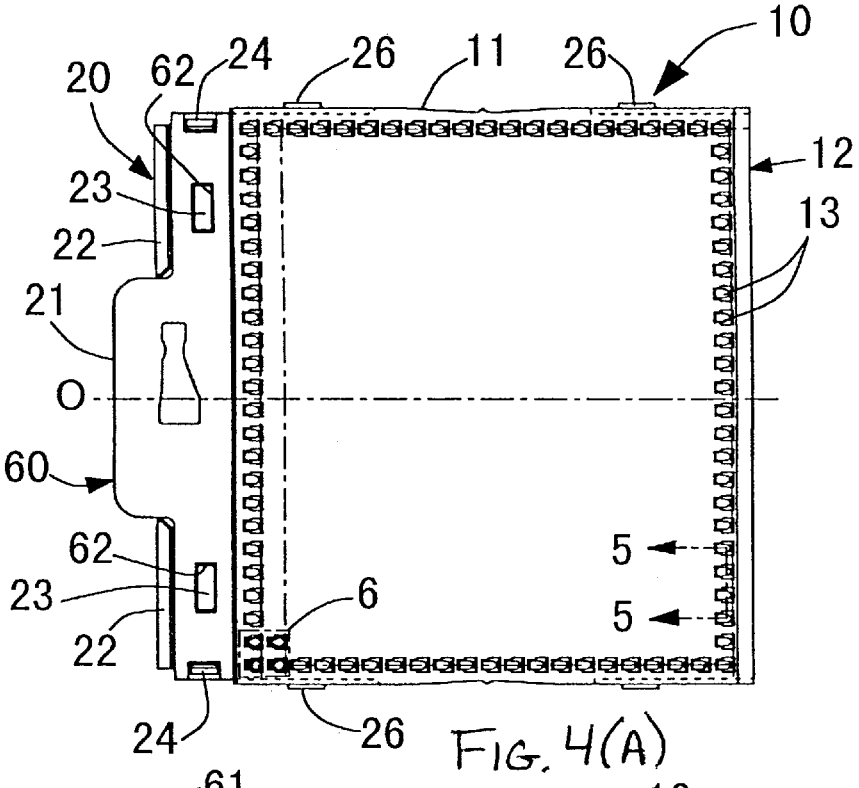

The ZIF type IC socket (hereafter referred to simply as an "IC socket") 1 shown in FIG. 1 is mounted on a circuit board (not shown in the figures), and is used for the mutual connection of the pins of a pin grid array type IC package and pads (not shown in the figures) on the circuit board. The IC socket 1 includes a base housing assembly 10 which accommodates numerous contacts 30 (see FIGS. 2, 5 and 6) disposed in the form of a matrix, and a cover housing assembly (slider) 40 which is disposed on the housing assembly 10 in a manner that allows movement in the horizontal direction. The housing assembly 10 shown in FIG. 4 consists of a base housing 11, numerous contacts 30, numerous solder balls 19 disposed on the undersurface of the housing 11, and a base supporting plate 60 disposed on the operating part 20 of the housing 11. The base housing 11 is formed by molding an appropriate plastic which has heat resistance and insulating properties such as a liquid crystal polymer, etc. This housing 11 consists of a contact accommodating part 12 which has rectangular shape as seen in a plan view, and an operating part 20 A which is formed as an integral part of the contact accommodating part 12 on the left side of the contact accommodating part 12 in FIG. 4(A). In the embodiment shown in FIG. 4, the base housing 11 has 495 contact accommodating cavities 13 (in a matrix of 24rows and 21 columns, with 9 cavities missing in the end portions), although some of these are omitted from FIG. 4. As shown in FIGS. 2 and 5, the respective contact accommodating cavities 13 are basically recesses which have bottoms and which open at the upper surface 14. Only insertion holes 16 into which the time parts 31 of the contacts 30 are inserted communicate with the undersurface 15 via solder ball accommodating recesses 17. The solder ball accommodating recesses 17 are formed with a shape resembling that of a mortar in positions corresponding to the respective contact accommodating cavities 13. The respective solder ball accommodating recesses 17 have tapered surfaces 18 that are substantially parallel to tangent lines of the accommodated solder balls 19, and have a depth that is greater than the radius of the solder balls 19. Furthermore, the tapered surfaces 18 are formed so that they center on the time parts 31. As a result, when the solder balls 19 are formed inside the recesses 17, the protruding height of the solder balls 19 from the undersurface of the housing 15 is controlled, and the centers of the solder balls 19 are caused to coincide with the centers of the recesses 17.

Figure 4C:
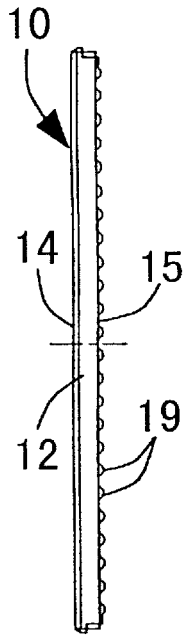
Figure 4B:
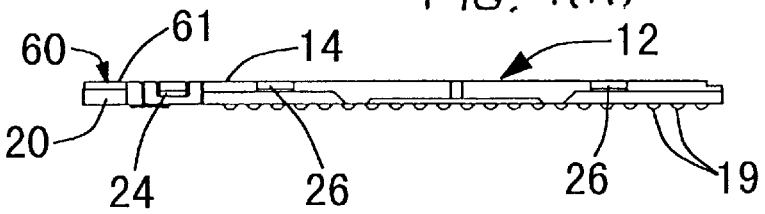
Figure 5:
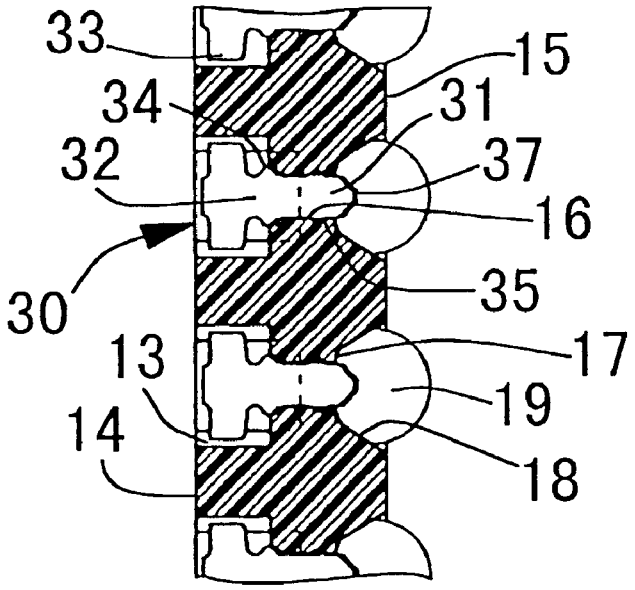
Figure 6:
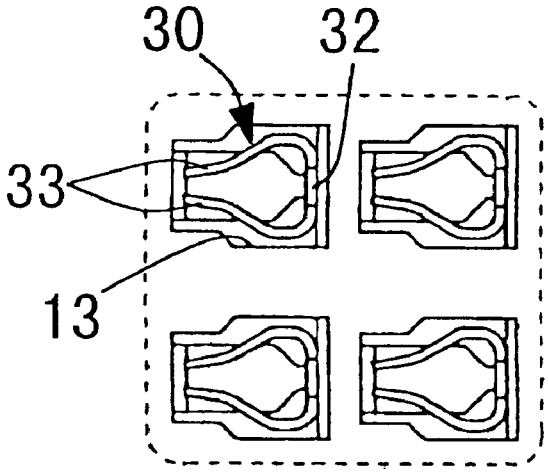

As shown in FIGS. 2, 5 and 6, the contacts 30 accommodated in the contact accommodating cavities 13 are formed by stamping and bending a metal plate which has good spring elasticity and conductivity such as beryllium steel, etc., and each contact 30 has a pair of contact arms 33 which extend toward the operating part 20 of the base housing 11 (i. e., to the left in FIG. 4(*a*)) from both sides of a base part 32. The pair of contact arms 33 on each contact 30 approach each other toward the tip ends of said contact arms 33. Stopper projections 34 are formed above, and press-fitting projections 35 are formed below, on both sides of the tine part 31 that extend downward from the base part 32. The stopper projections 34 are used to determine the lower limit of press-fitting of each contact 30. The press-fitting projections 35 are used to fasten the tine part 31 inside the corresponding insertion hole 16. The lower end 37 of each tine part 31 has the shape of a spear point, and protrudes into the interior of the corresponding solder ball accommodating recess 17. Accordingly, this lower end 37 makes reliable contact with the solder ball 19 accommodated inside the recess 17.

Figure 9C:
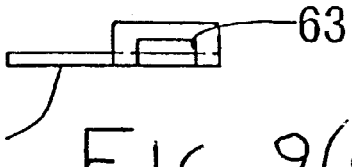
Figure 9B:
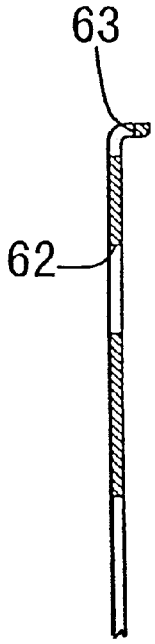

In FIG. 4, the operating part 20 of the base housing 11 has a protruding part 21 that protrudes to the left (in FIG. 4(A)) roughly in the center of the operating part 20, and roughly the entire operating part 20 including this protruding part 21 is covered by a base supporting plate 60 (see FIG. 9). The upper surface 61 of the base supporting plate 60 is set so that it is in substantially the same plane as the upper surface 14 of the contact accommodating part 12. The base supporting plate 60 is disposed inside a recess which is demarcated by the left-end wall 22 of the operating part 20 and the left edge of the contact accommodating part 12. Movement of the base supporting plate 60 in the horizontal direction relative to the base housing 11 is prevented as a result of projections 23 formed on the operating part 20 being fit into holes 62 formed in the supporting plate 60. Engaging projections 24 are formed on the end portions of the operating part 20 (with respect to the direction of the length of the operating part 20), and these engaging projections 24 engage with engaging holes 63 formed in both ends of the supporting plate 60, so that the base supporting plate 60 is prevented from slipping out of the base housing 11. A tool insertion hole (not shown in the figures) which is slightly larger than the tool insertion hole 65 formed in the base supporting plate 60 (see FIG. 9) is formed roughly in the center of the operating part 20.

Figure 9A:
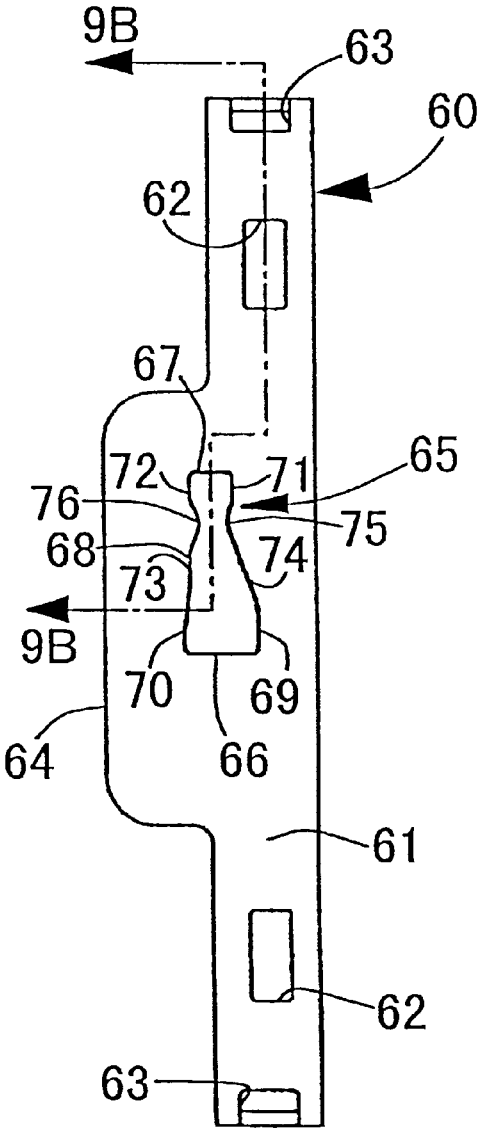
Figure 12:
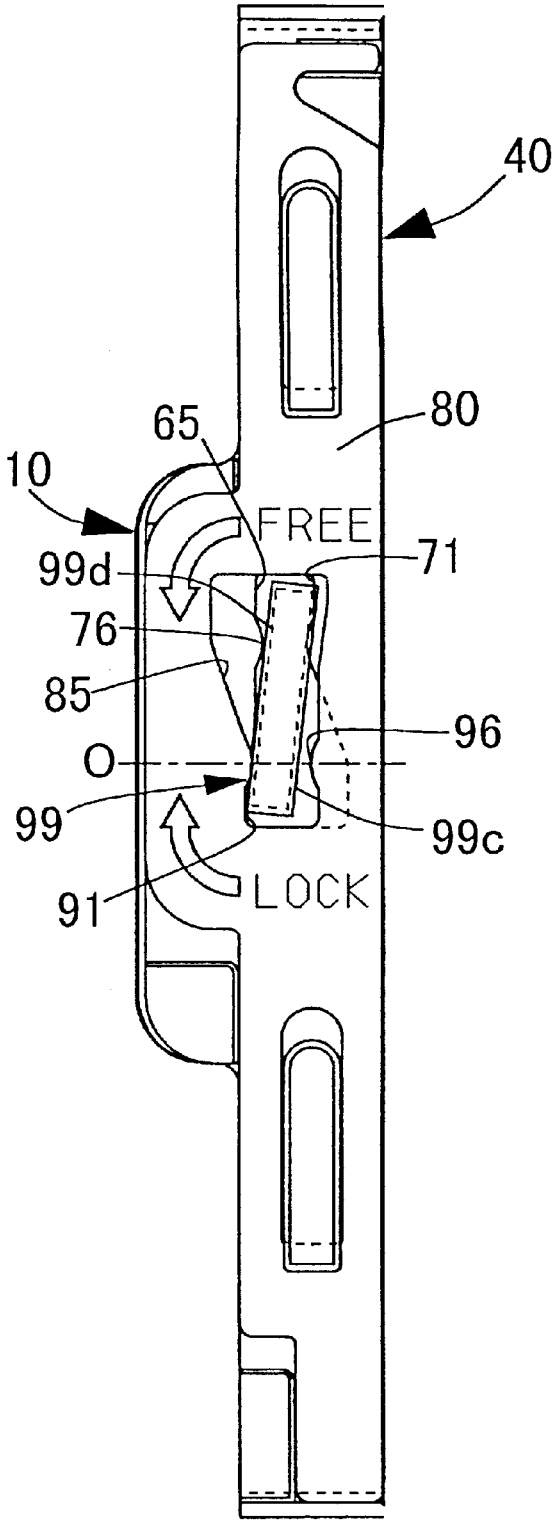
FIG. 12 is an enlarged view which illustrates the operating part of the present invention in a state in which the movement of the cover housing assembly has been completed.
Figure 13:
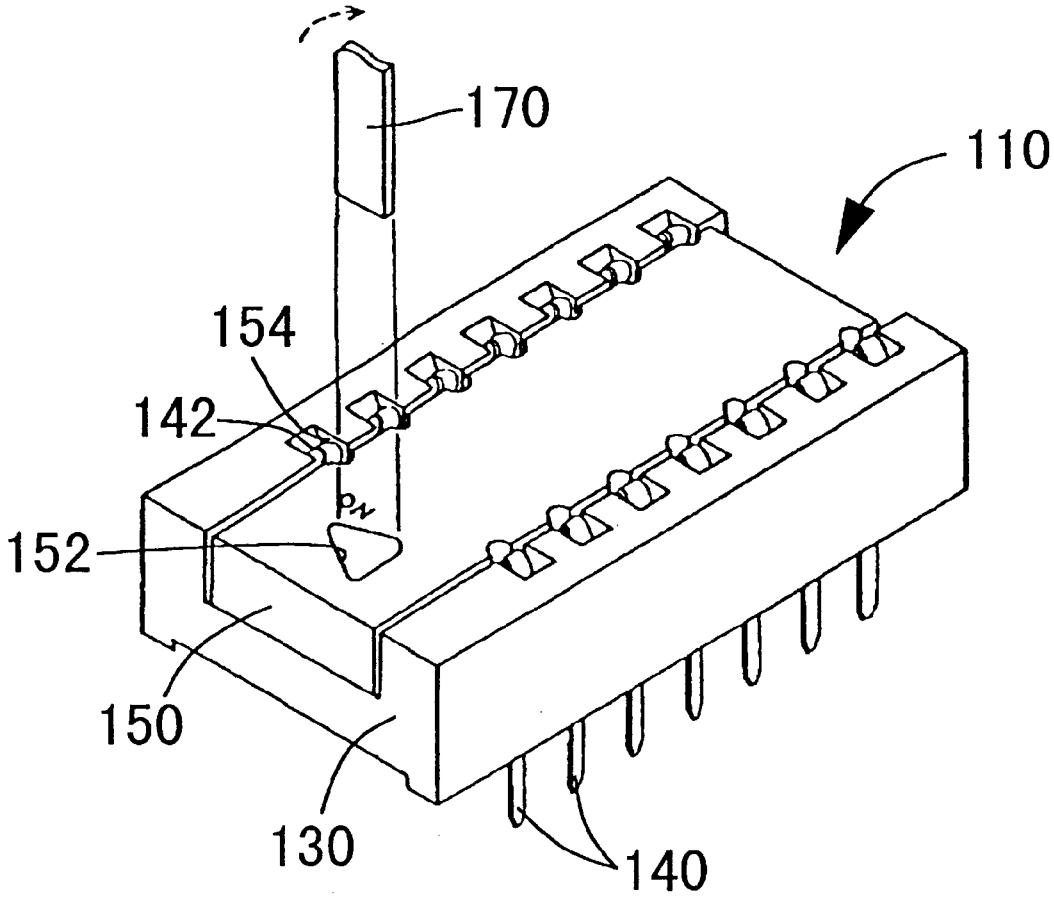
FIG. 13 (PRIOR ART)
FIG. 13 is an isometric view of a prior art ZIF type socket.
Figure 14:
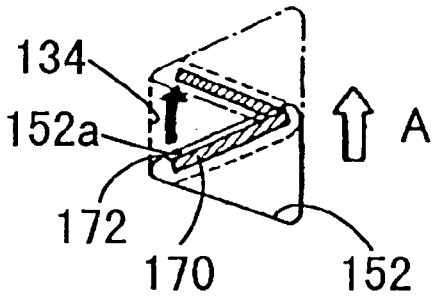
FIG. 14 (PRIOR ART)
FIG. 14 is a detail view of the operating part of the prior art ZIF type socket shown in FIG. 13.

In FIG. 9, the base supporting plate 60 is a flat-plate-form member (except for bent parts at both ends) which is formed by stamping and bending an appropriate metal plate that possesses rigidity and wear resistance, such as a plate consisting of stainless steel, etc. A tool insertion hole 65 which is offset in the upward direction in FIG. 9(A) is formed entirely through the base supporting plate 60 in roughly the central portion of the plate, which includes a protruding part 64 that protrudes to the left. In FIG. 9(A), the tool insertion hole 65 consists of a lower wide part 66, and upper narrow part 67 and a transitional part 68 that connects the wide and narrow parts. In the wide part 66, the right side 69 is substantially parallel to the direction of the axial line of the plate 60, while the left side 70 is a tapered surface that spreads outward as it progresses downward in FIG. 9(A). As is shown in FIG. 12, this is devised so that the side surface of the tool 99 will be parallel to the left side 70, and thus not interfere with the left side 70, when the movement of the cover housing assembly 40 is completed. The narrow part 67 has opposite sides 71 and 72 that are substantially parallel to each other. In the transitional part 68, the left side 73 is substantially parallel to the direction of the axial line of the plate 60, while the right side 74 is a tapered surface that spreads outward as it progresses downward, thus connecting the wide part 66 and narrow part 67. Circular-arc-form projections 75 and 76 are formed facing each other at the boundary between the narrow part 67 and the transitional part 68. The boundary between the tapered right side 74 of the transitional part 68 and the right side 69 of the wide part 66 is designed so that it coincides with the center of the plate 60 with respect to the direction of length.

Figure 7A:
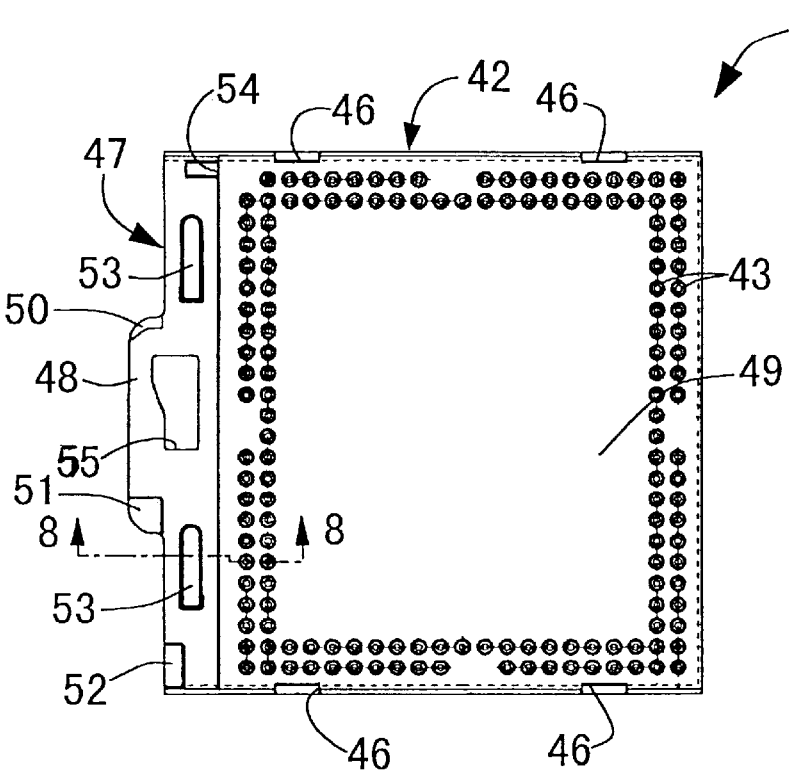
Figure 7C:
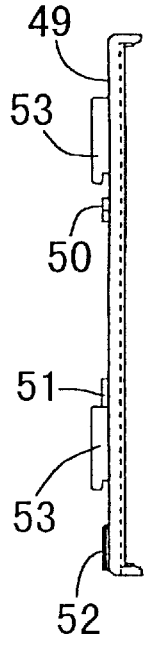
Figure 7B:
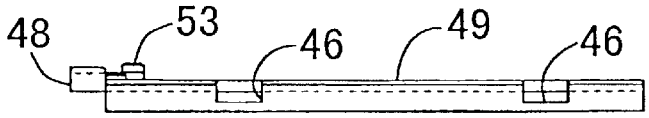
Figure 8:
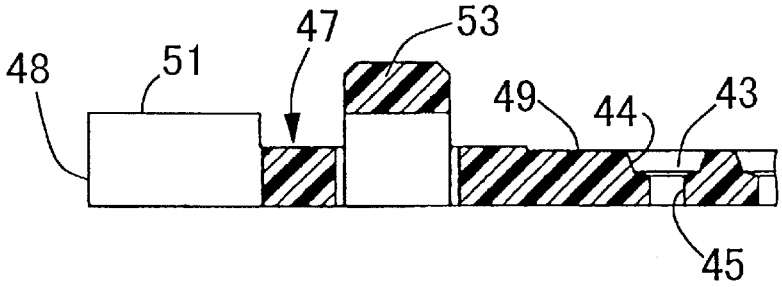

The cover housing assembly 40 (see FIG. 1) consists of the cover housing 41 shown in FIG. 7, and a cover supporting plate 80 (see FIG. 10) which is disposed on the operating part 47 of the housing 41. The cover housing 41 is formed by molding an appropriate plastic which has insulating properties. This housing 41 consists of an IC package carrying part 42 which has a rectangular shape as seen in a plan view, and an operating part 47 which is formed as an integral unit on the left side (in FIG. 7(A)) of this carrying part 42. The cover housing 41 has a number of pin through-holes 43 equal to the number of contact cavities 13, which are arranged in the form of a matrix. As is shown in FIG. 8, each of the pin through-holes 43 consists of a large-diameter part 44 that has a taper formed around its circumference, and a small-diameter part 45 that communicates with the large-diameter part 44. The large-diameter part 44 can securely accommodate a large-diameter flange (not shown in the figures) formed on the root of the corresponding pin.

Figure 3:
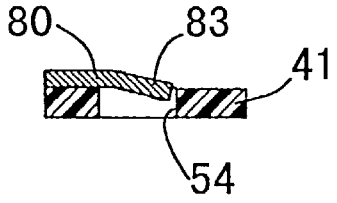
FIG. 3 is an enlarged sectional view of the present invention taken along line 3—3 in FIG. 1(A)

Engaging holes 46 which accommodate the engaging projections 26 on the side edges of the base housing 11 (see FIG. 4(A)) and hold cover housing assembly 40 relative to the base housing assembly 10 are formed in the upper and lower sides of the IC package carrying part 42 in FIG. 7(A). Since the respective engaging holes 46 are formed so that they are longer than projections 26 of the base housing 11 (see FIG. 1), the cover housing assembly 40 can move to the left and right (in FIG. 1(A)) relative to the base housing assembly 10. As in the case of the base housing 11, the operating part 47 has a protruding part 48 that protrudes to the left in FIG. 7(A) roughly in the center of the operating part 47, and roughly the entire operating part 47 including the protruding part 48 is covered by the cover supporting plate 80 (see FIG. 10). The main surface (upper surface) of the operating part 47 is in substantially the same plane as the upper surface 49 of the IC package carrying part 42. Accordingly, the upper surface 81 of the cover supporting plate 80 protrudes above the upper surface 49 of the IC package carrying part 42. The operating part 47 has projections 50, 51 and 52 on its left edge which receive the force applied to the cover supporting plate 80 by the tool (not shown in the figures). Furthermore, the operating part 47 has inverted L-shaped projections 53 which are disposed on both sides of the tool insertion hole 55. The projections 53 prevent the cover supporting plate 80 from slipping off of the cover housing 41, and also prevent the movement of the cover supporting plate 80 in the lateral direction in FIG. 7(A), by engaging with holes 82 formed in the cover supporting plate 80. When the cover supporting plate 80 is moved upward in FIG. 7(A) after the plate 80 has been installed on the operating part 47, so that the claw 83 on one end of the cover supporting plate 80 is pushed into the hole 54 in the operating part 47 of the cover housing 41 (see FIG. 3), the movement of the cover supporting plate 80 in the downward direction in FIG. 7(A) is prevented by the engagement of the claw 83 and hole 54. A tool insertion hole 55 which is larger than the tool insertion hole 85 formed in the cover supporting plate 80 is formed roughly in the center of the operating part 47.

Figure 10:
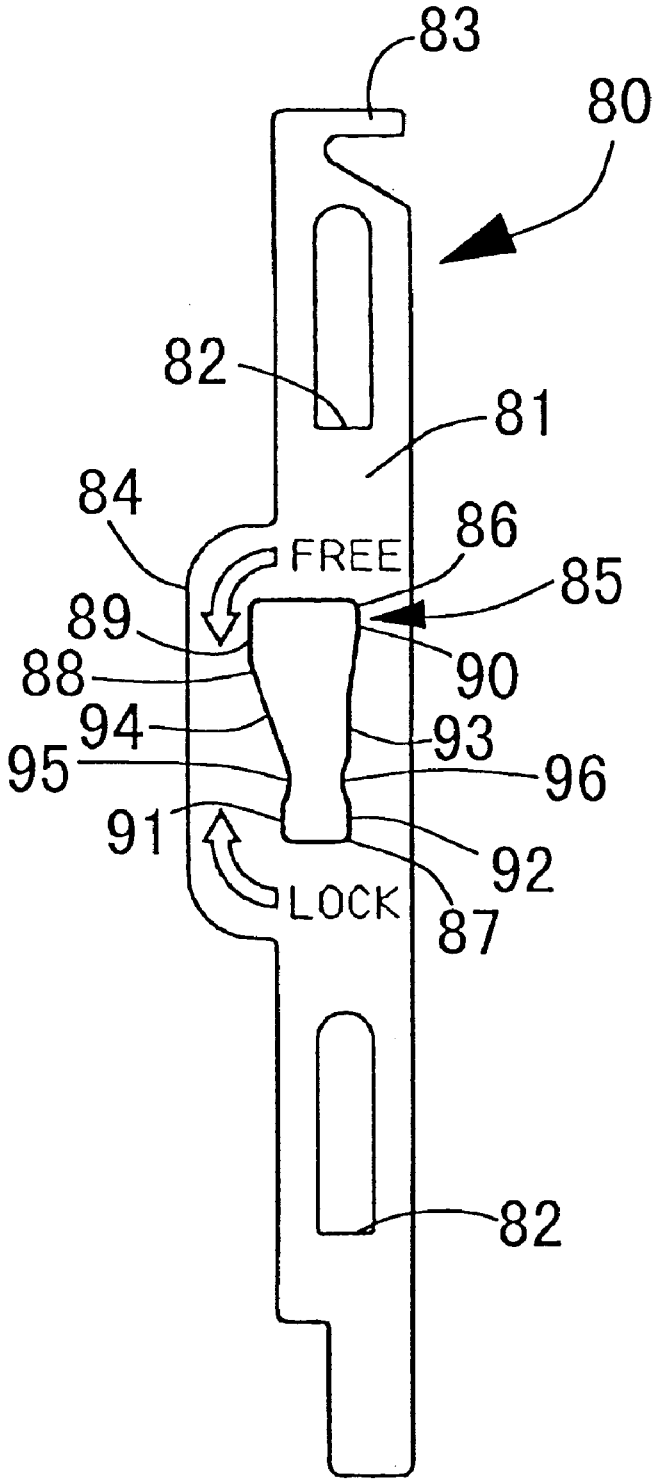
FIG. 10 is a plan view which illustrates the cover supporting plate of the present invention.

In FIG. 10, the cover supporting plate 80, like the base supporting plate 60, is flat plate-form member that is formed by stamping an appropriate metal plate that possesses rigidity and wear resistance, such as a plate consisting of stainless steel, etc. A tool insertion hole 85 similar to that of the base supporting plate 60 is formed through the center of the cover supporting plate 80 which includes the protruding part 84 that protrudes to the left. The overall shape of the tool insertion hole 85, which consists of a wide part 86, narrow part 87 and transitional part 88 that connects the wide part and narrow part, is similar to that of the tool insertion hole 65 formed in the base supporting plate 60. However, this tool insertion hole 85 differs from the tool insertion hole 65 of the base supporting cover 60 in that the orientation of the tool insertion hole 85 is rotated 180° from that of the tool insertion hole 65. Furthermore, the tool insertion hole 85 also differs from the tool insertion hole 65 in that the center of the tool insertion hole 85 substantially coincides with the center of the protruding part 84 with respect to the vertical direction in FIG. 10. Moreover, the circular-arc-form projections 95 and 96 of the tool insertion hole 85, which constitute the action points when the cover housing assembly 40 is driven using the tool 99 (see FIG. 11) are not positioned in the center of the cover supporting plate 80 with respect to the direction of length; instead, these projections 95 and 96 are set so that they are positioned on the center line O (with respect to the vertical direction) of the cover housing assembly 40 after the cover supporting plate 80 has been incorporated into the cover housing 41 as shown in FIG. 11.

Next, the operation of the ZIF type IC socket of the present invention will be described with reference to FIGS. 1, 11 and 12. In FIG. 1, which shows the state prior to the movement of the cover housing assembly, an IC package such as a CPU, etc. (not shown in the figures), is carried on the IC package carrying part 42. Next, as is shown in FIG. 11, a tool 99 with a rectangular cross-sectional shape such as a bladed screwdriver, etc. is inserted into the mutually communicating tool insertion holes 85 and 65, and this tool 99 is rotated in the clockwise direction. Since a bladed screwdriver generally has a narrowed point, the left-side surface 99*a* (solid line) of the tool 99 contacts the left-side circular-arc-form projection 95 of the cover supporting plate 80, while the right-side surface 99*b* (broken line) of the tool 99 contacts the right-side circular-arc-form projection 75 of the base supporting plate 60, so that the force from the tool 99 is received by the projections 95 and 75. As a result, the cover housing assembly 40 moves to the left relative to the base housing assembly 10.

Since the projections 95 and 75 are parts of the metal supporting plates 80 and 60 which possess rigidity, and since the contact surfaces of the projections 95 and 75 have a circular arc shape, these projections 95 and 75 have a large resistance to the force applied from the tool 99, so that the force from the tool 99 can be transmitted to the housing assemblies 10 and 40 without causing any indentation or damage, etc., of the supporting plates 80 and 60. Furthermore, since the sides 71 and 91 of the narrow parts 67 and 87 are relatively recessed as a result of the projections 75 and 95, there is no interference between the corners of the tool 99 and the sides 71 and 91 even in the state in which the movement is completed as shown in FIG. 12, so that, again, there is no indentation or damage of the sides 71 or 91 from corners of the tool. Moreover, since the circular-arc-form projections 95 and 96 are positioned on the center line O (with respect to the vertical direction) in FIG. 1(A), the cover housing assembly 40 as a whole can be uniformly moved to the left without any offsetting of the assembly 40 when the assembly 40 is caused to undergo relative movement. Furthermore, since the projections 75, 76, 95 and 96 are located in positions that are relatively close to the center of rotation of the tool 99, and since the distance between the projections 75 and 95 and the distance between the projections 76 and 96 (which are in respective diagonal relationships) are set so that these distances are shorter than the long side of the tool 99, only a small force is required for the rotational driving of the tool 99; furthermore, the long side of the tool can be securely caused to contact the projections 75, 76, 95 and 96 even in cases where the tool is slightly on the small side.

Figure 11:
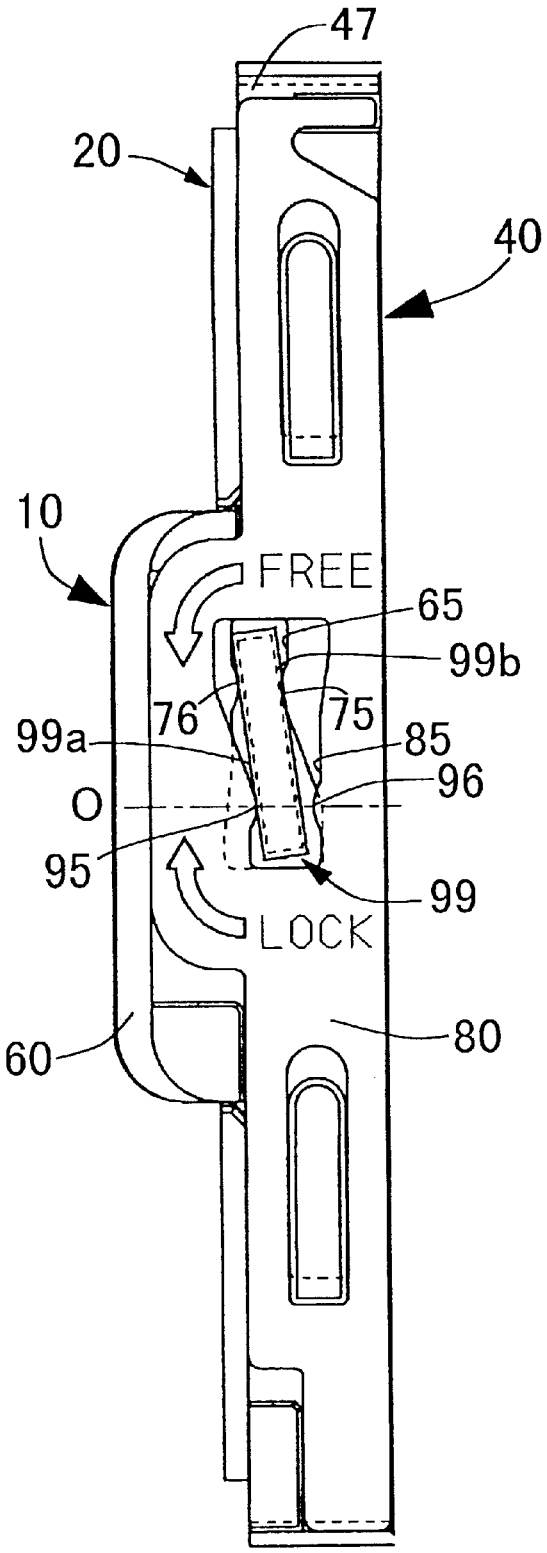
FIG. 11 is an enlarged view which illustrates the operating part of the present invention in a state prior to the movement of the cover housing assembly.

While the cover housing assembly 40 is in the process of moving from the state shown in FIG. 11 (or FIG. 1) to the state shown in FIG. 12, the pins (not shown in the figures) of the IC package that are inserted into the pin through-holes 43 of the cover housing 41 and inserted into the spaces between the base parts 32 and contact arms 33 of the contact 30, are forced into the spaces between the pairs of contact arms 33 of the contacts 33, so that the pins and contacts 30 are connected in the state shown in FIG. 12.

When the connection between the IC package and the contacts 30 is to be released, the tool 99 is inserted into the mutually communicating tool insertion holes 85 and 65, and is rotated in the counterclockwise direction. In this case, the right-side surface 99*c* (solid line) of the tool 99 contacts the right-side circular-arc-form projection 96 of the cover supporting plate 80, and the left-side surface 99*d* (broken line) of the tool 99 contacts the left-side circular-arc-form projection 76 of the base supporting plate 60, so that the projections 96 and 76 receive the force of the tool 99. As a result, the cover housing assembly 40 moves to the right relative to the base housing assembly 10.

An advantage of the ZIF type socket of the present invention is that the action points of the tool insertion holes formed in the base housing and slider that are contacted by the tool are formed as circular-arc-form projections. Accordingly, the force of the tool can be transmitted to the base housing and slider without causing indentation or damage, etc., of the tool insertion holes, so that a highly durable ZIF type socket can be obtained.

A further advantage is that the members that have the circular-arc-form projections may be metal members that are separate from the base housing and slider, and that are respectively attached to the base housing and slider. Accordingly, a ZIF type socket that has an even higher durability can be obtained.

A further advantage is realized since the distance between the circular-arc-form projections on the side of the base housing and the circular-arc-form projections on the side of the slider may be shorter than the length of the long side of the tool. Accordingly, only a small force is required for the rotational driving of the tool. Furthermore, the long side of the tool can be securely caused to contact the projections even in cases where the tool is slightly on the small side.

A preferred working configuration of the present invention was described above. However, the present invention is not limited to the above working configuration. It is clear that modifications and alterations may be made as necessary. For example, a configuration in which the respective sides 69 and 89 of the wide parts 66 and 86 of the tool insertion holes 65 and 85 are formed by extending the tapered side 74 and 94 of the transitional parts 68 and 88 would also be possible, or the tool insertion holes 65 and 85 could also be formed with other shapes, without sacrificing all of the material advantages of the present invention.

We claim:

1. A ZIF socket comprising:

a base housing that accommodates a plurality of contacts in a plurality of contact-receiving cavities;

a slider having a plurality of apertures corresponding to the plurality of contact-receiving cavities;

the slider and the base housing having tool insertion holes for receiving a bladed tool;

the tool insertion holes having circular-arc-form projections which function as action points when the bladed tool is inserted into the insertion holes and rotated, and where, upon rotation of the bladed tool, the slider is laterally moved.

2. The ZIF socket of claim 1, wherein a first metal plate is secured to the slider and a second metal plate is secured to the base housing, the first and second metal plates having tool insertion holes which communicate with the tool insertion holes in the slider and the base housing.

3. The ZIF socket of claim 2, wherein the tool insertion holes of the first metal plate and the slider are aligned and the tool insertion holes of the second metal plate and the base housing are aligned and oriented 180 degrees relative the tool insertion holes of the first metal plate and the slider.

4. The ZIF socket of claim 3, wherein the tool insertion holes have a narrow part and a wide part connected by a transition section, the narrow part having a circular-arc-form projection.

5. The ZIF socket of claim 1, wherein the tool insertion hole in the slider is in communication with the tool insertion hole in the base housing.

6. The ZIF socket of claim 5, wherein the tool insertion hole in the slider is oriented 180 degrees relative to the tool insertion hole in the base housing.

7. A ZIF socket comprising:

a base housing having a plurality of contacts disposed in a plurality of contact-receiving cavities;

a slider disposed on the base housing, the slider having a plurality of apertures which communicate with the plurality of contact-receiving cavities and which accommodate pins of an integrated circuit;

a first metal plate secured on the slider; and a second metal plate secured on the base housing and disposed between the base housing and the slider;

wherein a first tool receiving hole is provided in the first metal plate and the slider, and a second tool receiving hole is provided on the second metal plate and the base housing;

wherein circular-arc-form projections are disposed along walls of the first tool receiving hole and the second tool receiving hole to provide bearing surfaces for the bladed tool; and, wherein the first tool receiving hole and the second tool receiving hole are aligned to receive a bladed tool where, upon rotation of the bladed tool, the slider is moved laterally on the base housing.

8. The ZIF socket of claim 7, wherein the first tool receiving hole and the second tool receiving hole each have a narrow part and a wide part connected by a transition part, and wherein the first tool receiving hole is oriented 180 degrees relative the second tool receiving hole.

9. The ZIF socket of claim 8, wherein the circular-arc-form projection of the first tool receiving hole is diagonally opposite the circular-arc-form projection of the second tool receiving hole.

10. The ZIF socket of claim 9, wherein the circular-arc-form projection of the first tool receiving hole and the circular-arc-form projection of the second tool receiving hole are separated by a distance which is less than a length of each of the first and second tool receiving holes.

11. A tool actuated ZIF socket for receiving a pin grid array IC package, wherein the ZIF socket is laterally movable between an open position and a closed position via rotation of a bladed tool, the ZIF socket comprising:

a base housing having a plurality of contacts disposed in contact receiving cavities;

a slider having a plurality of apertures in communication with the contact receiving cavities for receiving pins of the IC package;

a first tool receiving hole in the base housing having a wall with a first projection; and a second tool receiving hole in the slider having a wall with a second projection, the second tool receiving hole being oriented 180 degrees relative the first tool receiving hole such that the first projection is diagonal and opposite to the second projection;

wherein the first tool receiving hole and the second tool receiving hole are aligned to receive the bladed tool and the first projection and the second projection provide bearing surfaces for rotation of the bladed tool.

12. The ZIF socket of claim 11, wherein the first projection and the second projection have a circular-arc-form shape.

13. The ZIF socket of claim 11, wherein a first metal plate is secured on the slider and a second metal plate is secured on the base housing, and wherein the first metal plate has a tool receiving hole having identical shape and being in alignment with the first tool receiving hole, and wherein the second metal plate has a tool receiving hole having identical shape and being in alignment with the second tool receiving hole.

* * * * *